US008464879B2

(12) United States Patent
Black, Jr. et al.

(10) Patent No.: US 8,464,879 B2
(45) Date of Patent: Jun. 18, 2013

(54) RETAIL DISPLAY STAND

(75) Inventors: Bailey Jean Black, Jr., Florence, AL (US); Bryan F. Magee, Killen, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 291 days.

(21) Appl. No.: 12/875,413

(22) Filed: Sep. 3, 2010

(65) Prior Publication Data

US 2012/0055890 A1 Mar. 8, 2012

(51) Int. Cl.

| | |
|---|---|
| ***A47B 43/00*** | (2006.01) |
| *A47F 5/14* | (2006.01) |
| *A47F 7/14* | (2006.01) |
| *A47G 29/00* | (2006.01) |
| *A47G 23/02* | (2006.01) |
| *A45D 19/04* | (2006.01) |
| *B62B 1/00* | (2006.01) |

(52) U.S. Cl.
USPC ..... 211/195; 211/50; 211/85.26; 211/181.1; 248/153; 248/175; 280/79.3

(58) Field of Classification Search
USPC ..... 211/28, 49.1, 50, 181.1, 182, 41.1, 211/41.14, 41.15, 41.16, 45, 195, 175, 189, 211/85.26, 85.31, 51, 47, 80, 165, 168, 169, 211/59.2, 59.3; 206/425, 736, 738, 740, 742, 206/756, 759, 774; 248/153, 107, 175; 280/47.35, 79.2, 79.3
See application file for complete search history.

(56) References Cited

U.S. PATENT DOCUMENTS

| | | | | | |
|---|---|---|---|---|---|
| 1,111,796 | A | * | 9/1914 | Hoffman | 248/129 |
| 1,642,497 | A | * | 9/1927 | Hope | 211/85.26 |
| 1,718,738 | A | * | 6/1929 | Friedemann | 211/153 |
| 1,969,220 | A | * | 8/1934 | Ingram | 211/50 |
| 2,488,262 | A | * | 11/1949 | Bengelsdorf | 211/51 |
| 2,680,522 | A | * | 6/1954 | Temple | 108/59 |
| 3,094,216 | A | * | 6/1963 | Gordon | 211/45 |
| 3,101,148 | A | * | 8/1963 | Brown | 108/163 |
| 3,168,329 | A | * | 2/1965 | Goldschmidt | 280/651 |
| 3,317,113 | A | * | 5/1967 | Humphrey | 206/425 |
| 4,416,463 | A | * | 11/1983 | Marsh et al. | 280/79.3 |
| 4,448,463 | A | * | 5/1984 | Amos | 312/111 |
| 4,586,614 | A | * | 5/1986 | Ger | 211/41.1 |
| 4,697,710 | A | | 10/1987 | Gradecki et al. | 211/45 |
| 4,978,013 | A | * | 12/1990 | Hogg | 211/133.2 |
| 5,027,956 | A | | 7/1991 | Lotufo | 211/45 |
| D336,752 | S | * | 6/1993 | Lattimer | D19/90 |
| 5,372,256 | A | * | 12/1994 | Chen | 206/425 |

(Continued)

*Primary Examiner* — Joshua J Michener
*Assistant Examiner* — Devin Barnett
(74) *Attorney, Agent, or Firm* — Brinks Hofer Gilson & Lione

(57) ABSTRACT

A display stand for sheet goods such as desk chair mats has a pair of upright side members and a base coupled to the side members. The base can have an upper surface to support a lower edge of sheet goods in a standing position. A protrusion can define an arcuate front lip along the retaining well. The arcuate front lip can be configured to impart a curvature to facilitate standing of the sheet goods. The upper surface of the base can be configured to have different elevations. A back member can be coupled to the upright side members, and can swing, slide, or both, between an open position to provide access to the sheet goods and a closed position to retain the sheet goods within the display. Signage panels can be coupled between the side members along a tie member to attract customers to the displayed goods.

20 Claims, 7 Drawing Sheets

U.S. PATENT DOCUMENTS

| | | | | |
|---|---|---|---|---|
| 5,484,064 | A * | 1/1996 | Melichar | 211/50 |
| 6,027,128 | A * | 2/2000 | Stich et al. | 280/47.16 |
| 6,092,674 | A * | 7/2000 | Rothstein et al. | 211/59.1 |
| 6,183,833 | B1 | 2/2001 | Robbins, III et al. | 428/80 |
| 6,308,842 | B1 | 10/2001 | Robbins, III et al. | 211/113 |
| 6,722,512 | B2 * | 4/2004 | Scully | 211/183 |
| 6,752,281 | B1 * | 6/2004 | Mason et al. | 211/195 |
| 6,942,112 | B2 | 9/2005 | Robbins, III | 211/113 |
| 2004/0150177 | A1 * | 8/2004 | Thiede et al. | 280/79.3 |
| 2005/0077256 | A1 * | 4/2005 | Hassett | 211/40 |
| 2005/0155905 | A1 * | 7/2005 | Monk | 206/751 |
| 2005/0242050 | A1 * | 11/2005 | Leyva Franco | 211/195 |
| 2006/0043032 | A1 * | 3/2006 | McHugh | 211/41.14 |
| 2006/0196838 | A1 * | 9/2006 | Mercure et al. | 211/41.1 |
| 2008/0023418 | A1 | 1/2008 | Robbins | 211/45 |
| 2008/0053867 | A1 | 3/2008 | Robbins | 206/756 |
| 2009/0188873 | A1 * | 7/2009 | Robbins, III | 211/41.1 |
| 2009/0188882 | A1 * | 7/2009 | Pirro et al. | 211/153 |

* cited by examiner

RETAIL DISPLAY STAND

BACKGROUND

The present disclosure relates to material handling of sheet goods and, specifically, to a retail display for somewhat flexible, semi-rigid to semi-flaccid sheet goods such as chair mats and floor mats.

Semi-rigid to semi-flaccid sheet goods such as desk mats, floor mats, carpet mats and chair mats used to protect an underlying surface present special challenges when it comes to presenting the goods in an attractive display that will also facilitate selection of the goods from the display by a purchaser. For example, chair mats for office and home use are well known. Such chair mats can simply be rectangular, or can have a main portion on which the desk chair rolls and a forward lip portion which is adapted to extend partially under the desk well, on which the feet of the person sitting in the chair may rest. Chair mats which are to be applied over carpeting typically have short protrusions, which can be relatively sharp spikes, on the undersides thereof that hold the mats firmly in place on the carpet surface. Typical chair mats are planar sheets of a polymeric material, such as vinyl plastic.

Such chair mats are now being found increasingly in retail outlets, compounding the need for a safe display of such goods. While such mats may be boxed, the boxes add cost and can be themselves unwieldy. As a result, boxes are not used to any great extent in the retail environment. Thus, with increasing retail activity, new displays are also required. Such chair mats present display problems since, absent the use of boxes or some support, they do not stand alone unless wound. In other words, when placed on its edge, a typical chair mat will not remain upright, but instead will bend under its own weight, which can be typically ten pounds or more. Even standing on edge in a wound or partially wound state, however, the mats are relatively unstable. Consequently, displays of chair mats, and other semi-rigid to semi-flaccid sheet goods present some special challenges.

This challenge is typically addressed by the use of a hanging display that suspends the sheet goods from a top edge so that the weight of the sheet goods acts to maintain the goods in an essentially planar configuration. The hanging display typically has horizontal display rods with a number of hooks depending from the display rod to receive for display the chair mats or other sheet goods of similar character. The goods can be suspended from the hooks in either a planar or folded conformation. The suspended sheet goods can be removed from the hooks by a retail consumer with relative ease so long as they are capable of lifting the weight of the goods. While such hanging displays operate quite satisfactorily in some locations, the hanging display may become unstable due to the weight of the goods if the load on the display is not maintained in an essentially balanced presentation of the goods.

Thus, there still remains a need for a more stable retail display of semi-rigid to semi-flaccid sheet goods such as chair mats and floor mats.

SUMMARY

One such display stand can have a pair of upright side members having a lower end. A base can be coupled to the lower end of each of the upright side members. The base can have an upper surface with a retaining well to support a lower edge of at least one sheet good to be stood upright in a standing position between the upright side members within the display stand. A protrusion can extend upward from the base surface to define an arcuate front lip along the retaining well. The arcuate front lip can be configured to impart a curvature to facilitate standing of the sheet good in the standing position. A back member can be coupled to at least one of the upright side members. The back member can be movable between a first position to allow transfer of a sheet good to and from the display stand and a second position to inhibit transfer of the sheet good to and from the display stand. The upper surface, which may include the retaining well, can have a portion that is configured to change in elevation. A tie member can be coupled to an upper end of each of the upright side members. A display panel can be coupled to the tie member to attract customers to the displayed goods. The display stand can be configured to allow advertising or identifying labels coupled to the sheet goods to be viewed from the front, that is, the side an approaching customer is most likely to first view.

In another example, a display stand can have a pair of upright side members having a lower end. A base can be coupled to the lower end of each of the upright side members. The base can have an upper surface to support a lower edge of at least one sheet good to be stood upright in a standing position between the upright side members within the display stand. At least one back member can be coupled to the upright side member. The back member can be capable of moving between an open position and a closed position. In the open position, a first side of the back member can be positioned away from the base to allow transfer of a sheet good to and from the display stand, and in the closed position, the first side can be positioned at the base to inhibit the transfer of a sheet good. The back member may be capable of swinging and/or sliding between the open position and the closed position. A first portion of the back member may have a lower end that, when the back member is in the closed position, may be selectively positionable along the upper surface of the base. The lower end of the first portion, when the back member is in the open position, may be positionable external to the base to a location lower than the upper surface of the base.

Yet, in another example, a display stand can have a pair of upright side members each having a lower end. A base can be coupled to the lower end of each of the upright side members. The base can have an upper surface with an inclined portion to support a lower edge of at least one sheet good to be stood upright in a standing position between the upright side members within the display stand. A protrusion may extend upward from the upper surface to define an arcuate front lip. The arcuate front lip can be configured to impart a curvature to facilitate standing of the sheet good in the standing position. A pair of back members can be coupled to the upright side members, each capable of moving between an open position and a closed position. In the open position, a first portion of each back member can be positioned away from the base to allow transfer of the sheet good. In the closed position, the first portion of the back member can be positioned at the base to inhibit of the sheet good. The upright side members may be configured to define a front surface of the display stand to support the at least one sheet good in the standing position. As sheet goods are transferred to and from the display, a lower end of each of the back members, when being moved to the closed position, may be selectively positioned along the upper surface of the base to contact the most rearward sheet good regardless of its position in the base. The combination of the front lip and the selective position of the back members may facilitate the retaining of all of the sheet goods in a standing position.

DESCRIPTION OF PREFERRED EMBODIMENTS

Figure 1:
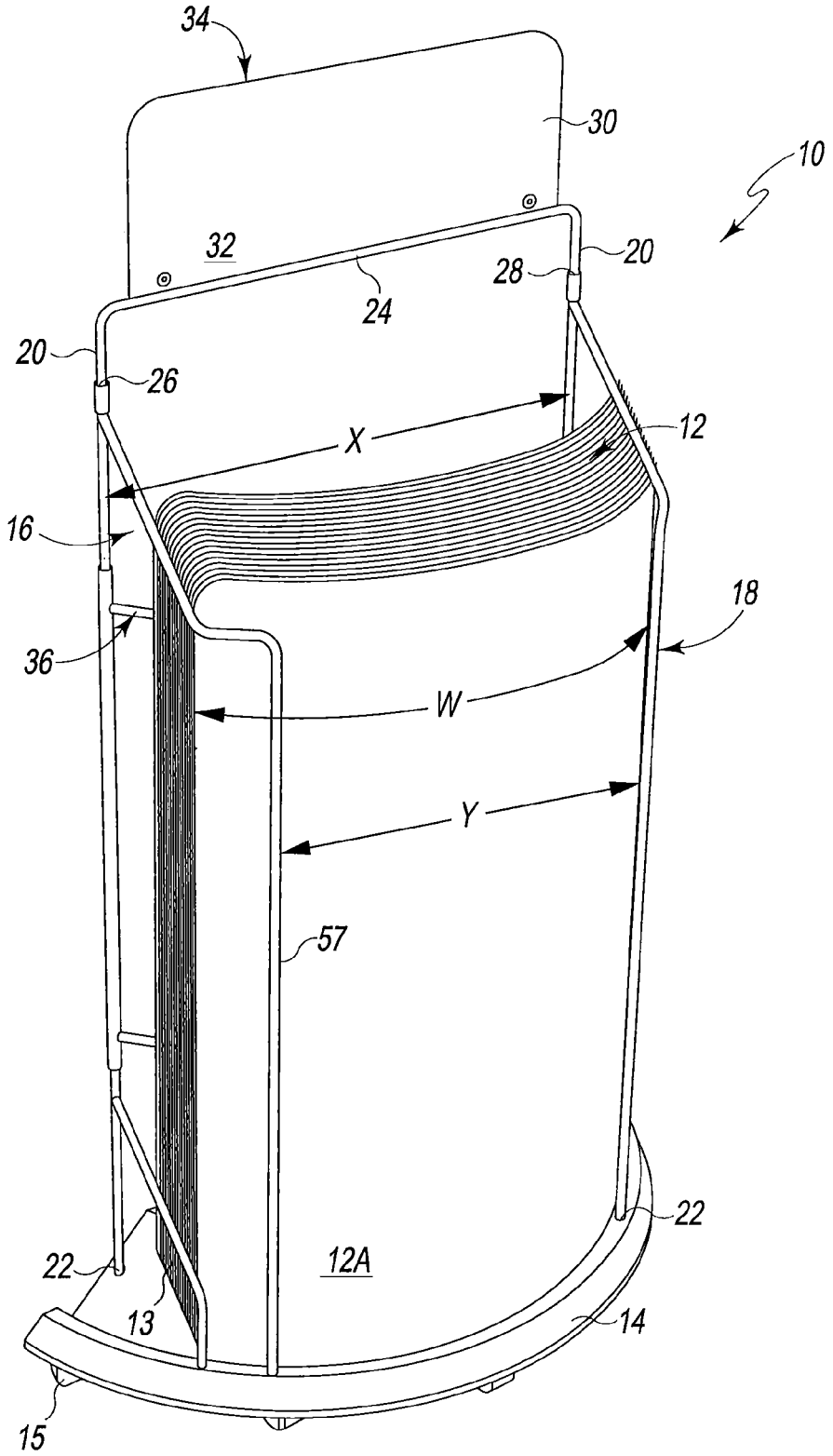
FIG. 1 is a perspective front view of a display stand containing a plurality of chair mats.

For the purposes of promoting an understanding of the principles of the present disclosure, reference will now be made to the embodiments illustrated in the drawings, and specific language will be used to describe the same. It should nevertheless be understood that no limitation of the scope of the invention is thereby intended, such alterations and further modifications in the illustrated apparatus, and such further applications of the principles of the present disclosure as illustrated therein being contemplated as would normally occur to one skilled in the art to which the invention relates. The components in the figures are not necessarily to scale, emphasis instead being placed upon illustrating the principles of the retail display. Moreover, in the figures, like referenced numerals designate corresponding parts throughout the different views.

The illustrated embodiments relate to a retail display that can be useful to material handling of sheet goods and, specifically, for somewhat flexible, semi-rigid to semi-flaccid desk chair mats. The retail display can be useful for exhibiting such sheet goods in an attractive manner and designed to ease the handling and improve marketability of such sheet goods. The retail display can provide for a floor-supported presentation rather than a suspended presentation to avoid any lack of stability arising from an unbalanced presentation of the goods, particularly due to the intrinsic weight of the goods. The retail display may have enhanced signage space, with product related graphics designed to attract customers to the displayed goods, and may even be configured to permit full display of the advertising or identifying labeling on such sheet goods. The retail display can be sufficiently robust to withstand the wear caused by the stocking and selection activities of particularly heavy sheet goods such as chair mats. Other features of the retail display and the corresponding advantages of those features will become apparent from the following discussion of preferred embodiments of the present disclosure.

FIG. 1 depicts a retail display 10 for a plurality of sheet goods 12. The sheet goods 12 can be somewhat flexible, semi-rigid to semi-flaccid planar sheets of a polymeric material, such as vinyl plastic. The sheet goods 12 can be desk mats, floor mats, carpet mats, or desk chair mats that are used to protect an underlying surface. In one example, the desk chair mat can include a front side that is preferably substantially smooth to allow a desk chair to roll freely. The underside of the desk chair mat can also be smooth or can be formed with integral cleats or spikes to hold more firmly into a carpeted surface. The desk chair mats can be provided with one or more handles along a side edge thereof to facilitate handling and carrying of the desk chair mat. Although the sheet goods can be any size, one example sheet good is a chair mat that is about 36 inches (W)×48 inches (L)×⅛ inches (thickness) with 3/16-inch cleats. An advertising or identifying label can be attached to either the front side or the underside of the desk chair mat where such label can be seen from the front side.

The display 10 can be a floor-supported display having a base 14 that can be supported directly on a support surface such as a sales floor of a retail establishment. A plurality of rollers or castors 15 can be provided along a lower surface of the base 14 so that the display can be easily moved and repositioned along the floor. Extending upward from the base 14 is a pair of sidewalls 16, 18, which can have an upper end 20 and a lower end 22 that is coupled to the base 14.

The sidewalls 16, 18 can be coupled together in spaced relation by one or more tie members 24. The tie member 24 can include ends 26, 28 that can be coupled proximate the upper ends 20 of the sidewalls 16, 18. A signage panel 30 can be fixed between the two sidewalls 16, 18 and/or along the tie member 24, generally above the tie member 24. The signage panel 30 can include suitable commercial and/or informational messages on both a forward facing surface 32 and a rearward facing surface 34. One or more back members 36 can be coupled to the sidewalls 16, 18 and/or the base 14. As described in further detail below, the back member 36 can be moved between a closed position (FIG. 7) to further contain the sheet goods for display and an open position (FIG. 6) to permit access to the sheet goods from the rearward side.

Figure 2:
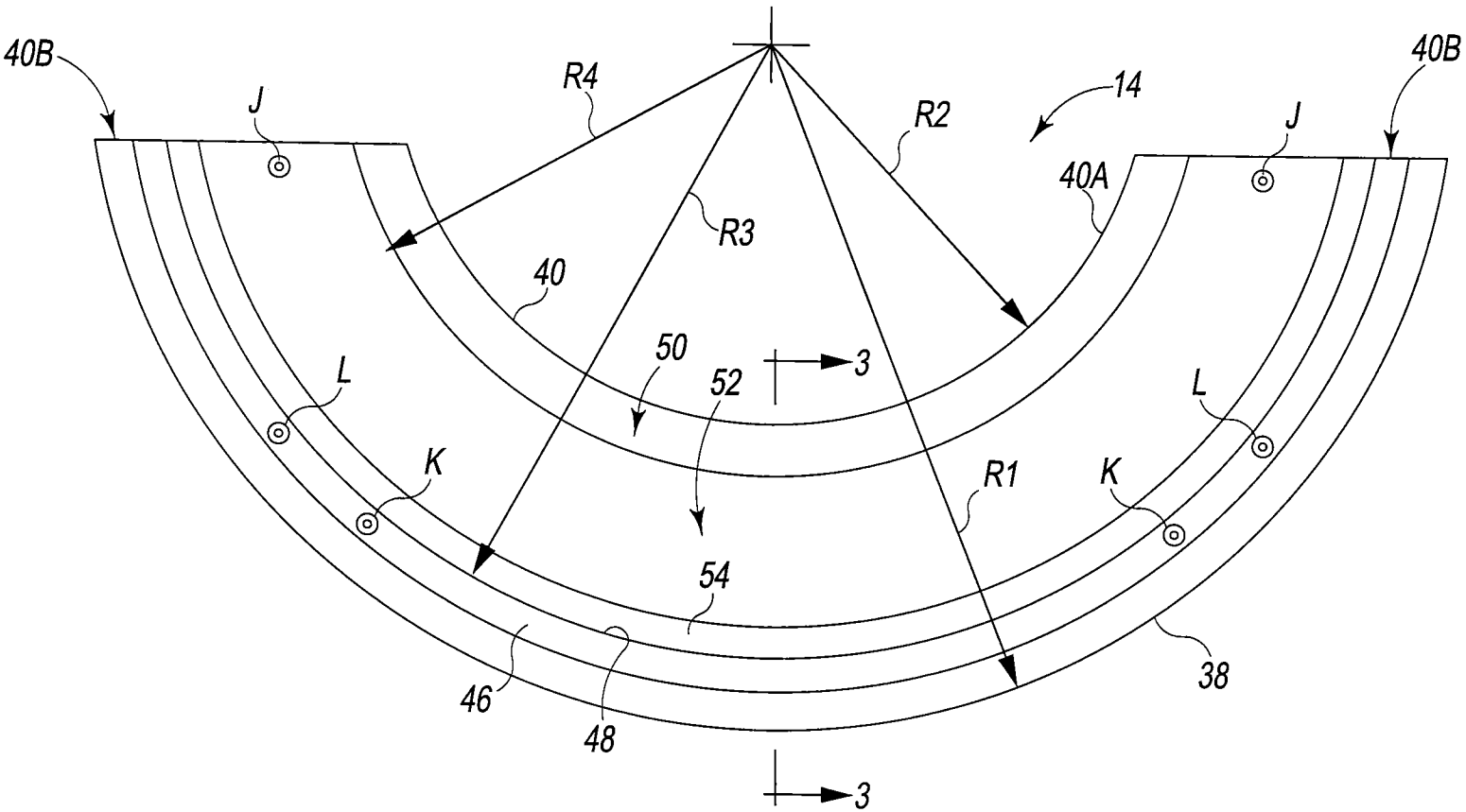
FIG. 2 is a top view of a base for a display stand.

FIG. 2 illustrates one embodiment of the base 14 having a frontward margin 38 spaced from a rearward margin 40. The base 14 can be arcuate so that one or both of the frontward margin 38 and the rearward margin 40 are arcuate. When both are arcuate, the frontward margin 38 and the rearward margin 40 can be concentric or eccentric. In other words, when the frontward and rearward margins 38, 49 are concentric, which is shown in FIG. 2, they share a common center point, with the frontward margin 38 having a radius of curvature R1 greater than a radius of curvature R2 of the rearward margin 40. Optionally, when the frontward and rearward margins 38, 40 are eccentric they do not share a common center point, that is the frontward margin radius of curvature R1 is different (i.e., greater or less than) than the rearward margin radius of curvature R2. The rearward margin 40 may also have an arcuate portion 40A and planar portions 40B to define a generally rear side. As can be appreciated by those skilled in the art, any of the bases described herein can be made of various plastics, woods, or metals by various manufacturing methods such as molding, casting, and machining.

The base 14 and the sidewalls 16, 18 are configured to maintain the sheet goods 12 curved in an arc as shown in FIG. 1. This arrangement can facilitate the sheet goods to remain upright when placed on its bottom edge 13 instead of bending vertically under their own weight. A general linear distance X between the sidewall 16 and the sidewall 18 may be smaller than the width W of the sheet goods 12 measured along the arc.

Figure 3:
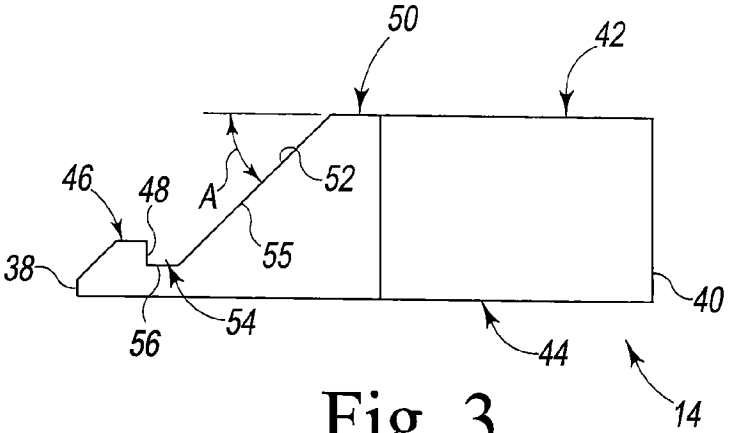
FIG. 3 is a cross-sectional view of the base of FIG. 2, taken along line 3-3.

In FIG. 3, the frontward and rearward margins 38, 40 are coupled to one another by an upper surface 42 and a lower surface 44. The lower surface 44 can be generally planar and parallel to the support surface so that the lower surface can be supported directly there upon. A first protruding portion 46 along the upper surface 42 can extend upward relative to adjacent upper surfaces to define a frontward lip 48. The frontward lip 48 can be generally aligned with the frontward margin 38. FIG. 3 depicts the frontward lip 48 can be concentric with the frontward margin 38, and can define a radius of curvature R3 that is less than R1. The frontward lip 48 provides a supporting edge for the lower end of the most forward sheet good 12A. The frontward lip 48 can further impart the desired initial curvature of the sheet goods 12 to facilitate the sheet good when in a standing position to remain upright when placed on its bottom edge 13 instead of bending under its own weight.

A second protruding portion 50 along the base upper surface 42 can extend upward relative to adjacent upper surfaces to define a rearward lip 52. The rearward lip 52 can provide a supporting edge for the lower end of the most rearward sheet good, and can further provide the desired ending curvature of the sheet goods 12 to facilitate the sheet good to remain upright when placed on its bottom edge 13. The rearward lip can be generally aligned with the rearward margin 40. FIG. 3 depicts the rearward lip 52 can be concentric with the frontward lip 48, and can define a radius of curvature R4 that is less than R3.

The frontward and rearward lips 48, 52 can be spaced from another to define the general edges of a well 54 for retaining any suitable number of upright sheet goods 12. In FIG. 3, the second protruding portion 50 can extend vertically from the lower surface 44 farther than the first protruding portion 46. A portion 56 of the well 54 can define a lowermost surface relative to the first protruding portion 46 and the second protruding surface 50 that is generally parallel to the lower surface 44. This portion 56 of the well 54 can be sized to receive one or more sheet goods.

The well 54 can include an inclined surface 55 somewhere between the first protruding portion 46 and the second protruding portion 50 at an angle A relative to the base lower end 44 to orient the bottom edge 13 of adjacent sheet goods at different elevations. This inclined surface can further impart curvature conformity to the sheet goods 12 and urge the sheet goods to lean forward against a front edge 57 of the display to facilitate the sheet goods to remain upright when placed on its bottom edge 13 instead of bending under its own weight. The inclined surface 55 can be a continuously inclined surface. The angle A of incline can be any angle from 0 to 90 degrees relative to the upper surface 42 when the upper surface is generally parallel to the support surface. The angle A is preferably an angle in the range of about 40 degrees to about 50 degrees, and alternatively about 46 degrees, relative to the upper surface 42.

Figure 4B:
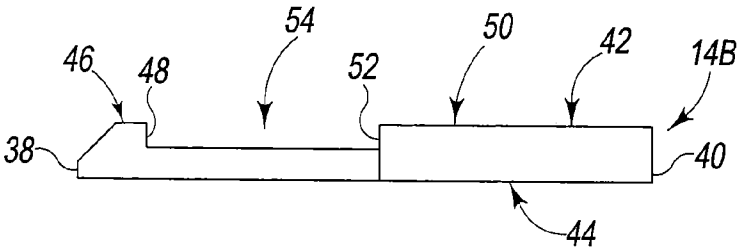
FIGS. 4A-4B are cross-sectional views of alternative embodiments of a base for a display stand.
Figure 4A:
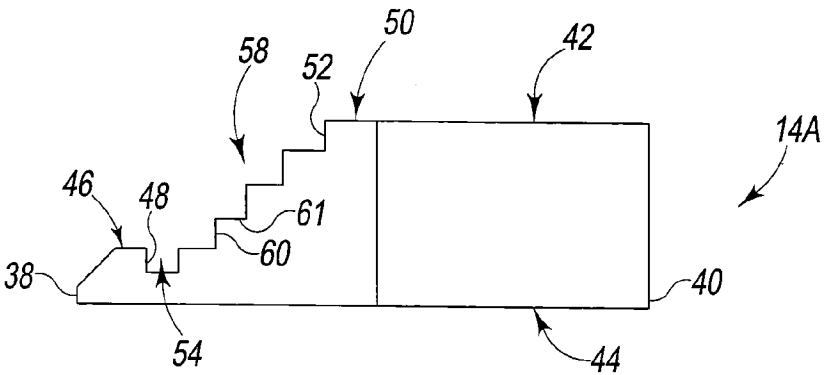

FIG. 4A illustrates an alternative base 14A having identical features to the base 14, except for the following features. The well 54A includes one or more steps 58 to orient the bottom edge 13 of the sheet goods at different elevations. A riser portion 60 and a run portion 61 of each step 56 can be perpendicular to one another. The riser portion 60 can extend generally perpendicular to the base lower end 44, and the run portion 61 can extend generally parallel to the base lower end 44. However, those skilled in the art can appreciate that the riser and run portions 60, 61 of the step 56 can be obliquely oriented with the respect to base lower end 44. This arrangement can be better understood with reference to the description of FIG. 3. The height of the riser portion 60 can be any distance, while the length of the run portion 61 can by any distance but is preferably long enough to support the width of the bottom edge 13 of the sheet good 12. The general incline of the stepped well can define a general angle that is substantially identical to the angle A. Optionally, the base 14 can include a well without an inclined portion, as shown in FIG. 4B. Here, the frontward and rearward lips 48, 52 define a well 54 having a substantially planar lower surface.

Figure 5:
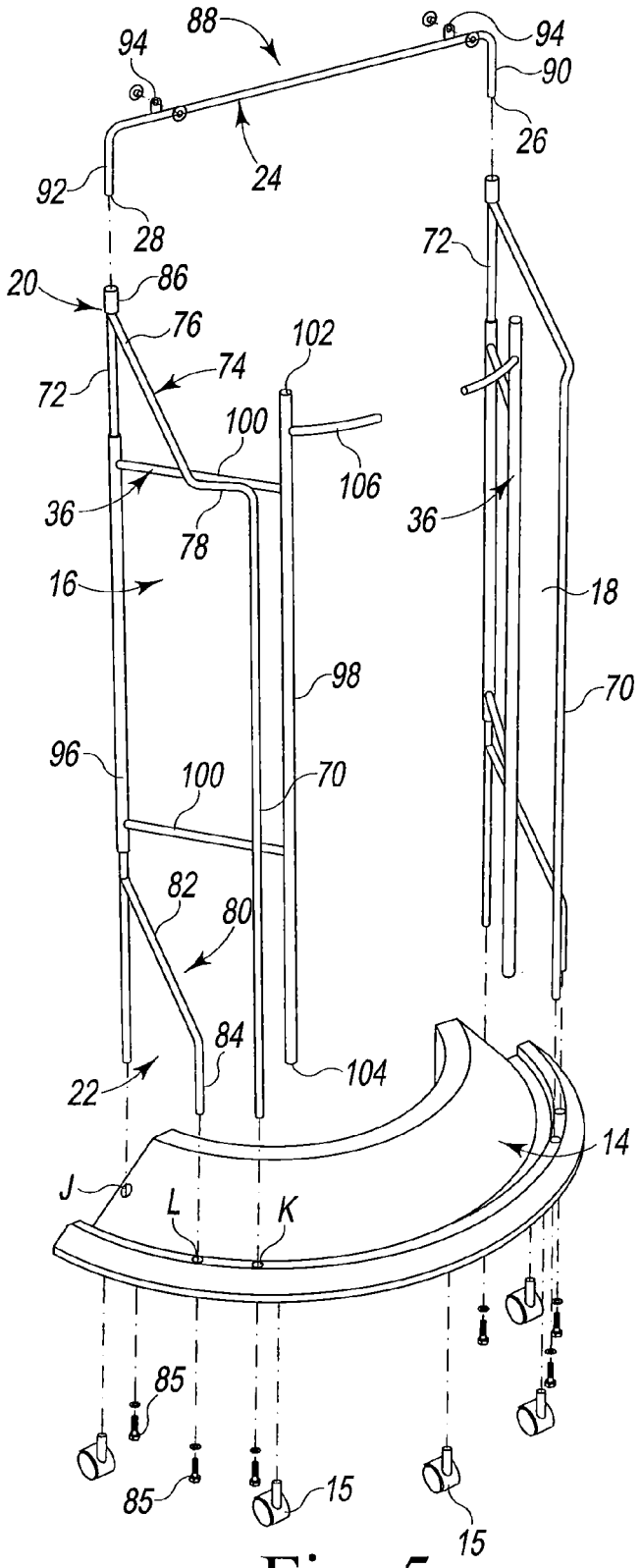
FIG. 5 is an exploded perspective view of a display stand.

In FIG. 5, each of the sidewalls 16, 18 can include a front vertical standard 70 and a rear vertical standard 72 each having lower ends that generally define the lower ends 22 of the sidewall that can be coupled to the base 14. A support member 74 can be fixed between the upper ends of the vertical standards 70, 72, and be configured so that the vertical standards can extend at different elevations. In other words, the upper end of the rear vertical standard 72 can extend vertically past the upper end of the front vertical standard 70. The support member 74 can have a first end fixed to the rear vertical standard 72 and a second end fixed to the front vertical standard. A first potion 76 of the support member 74, extending from its first end, can be oriented obliquely to the rear vertical standard 72 at any angle but preferably in an angle in the range of 40 to 50 degrees relative to the vertical standard. A second portion 78 of the support member 74, extending from its second end to the first portion 76, can be substantially perpendicular to the vertical standards. The location of coupling of the first end of the support member 74 and the upper end of the rear vertical standard 72 can generally define the upper end 24 of the sidewall.

A buttress rod 80 can also be included in the sidewall. The buttress rod 80 can have a first end fixed to the rear vertical standard 72 and a second end that is to be coupled to the base 14. A first potion 82 of the buttress rod 80, extending from its first end, can be oriented obliquely to the rear vertical standard 72 at any angle but preferably in an angle in the range of 40 to 50 degrees relative to the vertical standard. A second portion 84 of the buttress rod 80, extending from its second end to join to the first portion 82, can be substantially parallel to the vertical standards.

The general lower end 22 of the sidewalls can be coupled to the base by various means as appreciated by those skilled in the art, including welding, soldering, fasteners, adhesives, or the like. Referring to FIG. 2 and FIG. 5, the lower end of the rear vertical standards 72 can extend through a first opening J formed in the base 14. The lower end of the front vertical standards 70 can extend through a second opening K formed in the base 14. The second end of the buttress rod can extend through a third opening L in the base. Each of the ends can be configured to be coupled by a fastener. For example, the ends can include a threaded bore adapted to threadably engage with a threaded fastener 85 that is inserted from the lower surface 44 of the base 14 through each of the openings, with an optional washer.

According to FIG. 2, the first opening J can be located within an intermediate portion of the well 54. The second opening K and the third opening L can be located at the first protruding surface 46, which are shown along the same radius of curvature. The first opening J and the third opening L can be spaced and oriented along a plane that is substantially perpendicular to a plane formed by each of the rear vertical standards. The first opening J and the second opening K can be spaced and oriented relative to each other along a plane that is oblique to a plane formed by each of the rear vertical standards. This spacing and orientation can allow the rear vertical standard 72, the buttress rod 80 including the first and second portions 82, 84, and the first portion 76 of the support member 74 to be oriented along a plane that is substantially perpendicular to a plane passing through each of the rear vertical standards. The front vertical standard 70 and the second portion 78 of the support member 74 can be then oriented along a plane that is oblique, e.g., about 40 degrees to about 50 degrees, to a plane passing through each of the rear vertical standards so that the second portion 78 in combination with the front vertical standard form the front edges 57 for supporting the sheet goods, as shown in FIG. 1.

The linear distance X can be further defined between the pair of rear vertical standards 72. The spacing between the two front vertical standards 70 that generally define the front edges 57 can be defined by a linear distance Y that can be smaller than the distance X. The distance Y can be suitable to permit exhibition of a substantial portion of the sheet good from the front.

In FIG. 5, the tie member 24 can be coupled between the sidewalls 16, 18 by various coupling means as appreciated by those skilled in the art, including welding, soldering, fasteners, adhesives, or the like. In one example, a coupling member 86 can be provided either at the upper end 20 of the sidewalls or the ends 24, 26 of the tie member 24. The coupling member 86 can include a bore sized to receive an end of the tie member and an upper end of the sidewall. The coupling member 86 can be fixedly attached to one of the ends of the sidewall or the tie member, and the other of the ends can be inserted into the bore of the coupling member. A set screw (not shown) can be tightened to fixedly engage the other of the ends and loosened to allow for removal of the other of the ends as appreciated by those skilled in the art.

The tie member 24 can have an intermediate portion 88 that is substantially horizontal, and end portions 90, 92, which have the respective ends 26, 24 bent relative to the intermediate portion in order to be in alignment with the rear vertical standards 72. One or more panel coupling members 94 can be attached along the upper end of the intermediate portion 88 to allow the display of the signage panel 30 as depicted in FIG. 1. The panel coupling members 94 can include a plate extending from the surface of the intermediate portion 88, generally aligned with the tie member, with an aperture extending perpendicular to the tie member. The signage panel 30 can have openings that correspond to the location of the aperture of the panel coupling members 94 for receiving fasteners such as snap rivets to fix the signage panel 30 to the tie member 24. Other means for attaching the tie member to the signage panel can, be used such as, but not limited to, welding, soldering, adhesives, or the like.

According to FIG. 5, the back member 36 can include a first leg 96 coupled to the rear vertical standard 72, a second leg 98 spaced from the first leg 96, and one or more support members 100 fixed between the first leg 96 and the second leg 98. The first leg 96 may be substantially parallel with the second leg 98, while the support member 100 can be generally horizontal. The back member 36 is preferably attached to the rear vertical standard 72 in a manner to allow the back member 36 to swing between the closed and open positions. In one example, the first leg 96 can include at least a portion surrounding the rear vertical standard 72, although the entire first leg may surround the vertical standard. In other words, the first leg portion 96 can be a tubular member configured to receive the vertical standard 72 so that a hinge is formed therebetween. The hinged arrangement can permit the back member 36 to swing relative to the stationary vertical standard 72. It can be appreciated by one skilled in the art that the first leg can be pivotably attached to the vertical standards by other means including use of a separate hinge component between the respective components. In another example, a spring member and/or dampening member can be coupled to the back member to bias the back member in one of the open or close positions and control the return rate of the biased position.

The back member 36 can also be attached to the rear vertical standard 72 in a manner to allow the back member 36 to vertically move between a first position and a second position. The first position can be defined when the upper end of the first leg 96 physically contacts the joint between the rear vertical standard 72 and the first portion 76 of the support member 76. The second position can be defined when the lower end of the first leg 96 physically contacts the joint between the rear vertical standard 72 and the first portion 82 of the buttress rod 82. In one example, the first leg 96 is configured to allow the first leg 96 to slide along the rear vertical standard 72 so that the elevation of the entire back member 36 can be changed. This arrangement can facilitate the swinging movement of the back member 36 while transitioning from the closed position to the open position. The second leg 98 has an upper end 102 that may extend past the upper end of the first leg 96. A lower end 104 of the second leg 98 can be removably attached to the base 14. This arrangement can retain the back member 36 in the closed position. In one aspect, the lower end 104 of the second leg 98 can frictionally engage along any portion of the upper surface of the base 14, including any portion of the well 54. In another aspect, additional openings (not shown) can be formed in the base in order to receive the lower end 104 of the second leg. When the lower end 104 is removed from the base 14, the back member 36 is capable of swinging to the open position, as shown in FIG. 6.

A retaining member 106 can be fixed to the second leg 98. The retaining member 106 can be oriented inward from the sidewalls to apply a forward pressure to the sheet goods in order to inhibit the sheet goods from falling out in the rearward direction when the back member 36 is in the closed position. The retaining member 106 may even be oriented in the frontward direction to facilitate the engagement of the most rearward sheet good. The retaining member 106 can be attached along an upper portion of the second leg 98 and can be angled, e.g., about 45 degrees, or have a curvature to support along the curvature of the upper portion of the sheet goods. The back member 36 can provide a support surface from the rear of the sheet goods, and can also apply a pressure in the frontward direction secure the sheet goods in the standing position. As can be appreciated by those skilled in the art, components of each of the sidewalls and the back members described herein can be made of various plastics, woods, or metals. Although the components are shown as circular rods, the cross-section of the components can be other known shapes such as rectangular, elliptical, or the like, either solid or tubular.

Figure 6:
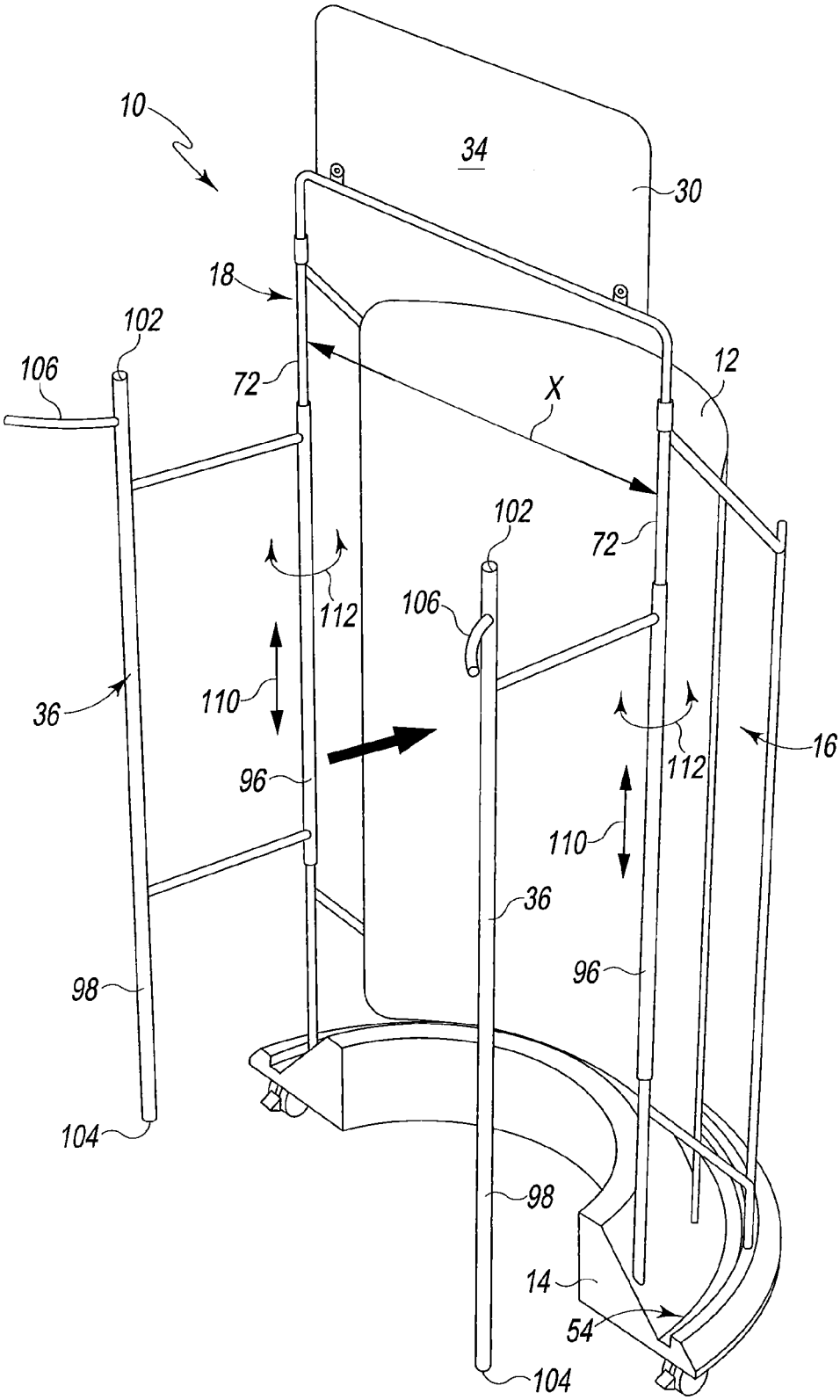
FIG. 6 is a perspective rear view of a display stand, with a pair of back members in an open position.
Figure 7:
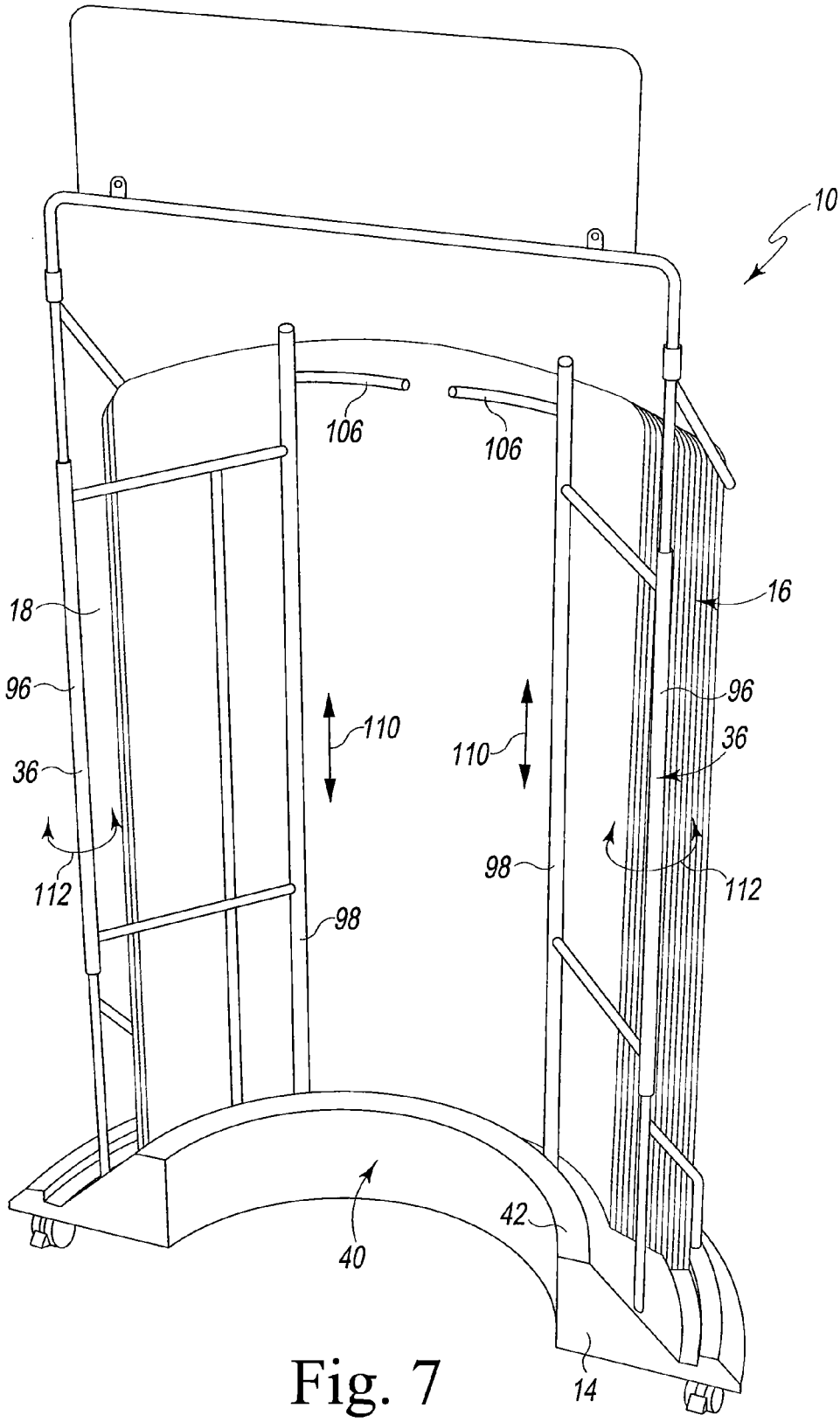
FIG. 7 is a perspective rear view of a display stand, with a pair of back members in a closed position.

FIG. 6 shows two back members 36 in the open position to allow the sheet goods 12 to be inserted or removed from the rear side of the display. FIG. 7 shows two back members 36 in the closed position to retain the sheet goods. The back member 36 can be swung to a position suitable to gain full access between the sidewalls 16, 18. The lower end 104 of the second leg 98 of the back member 36 can be positioned on the underlying support surface that is below the base 14 since the back member 36 is capable of changing elevations, as indicated by arrows 110. This can allow the lower end 104 to frictionally engage the underlying surface in order to maintain generally a fixed open position and inhibit the back member from swinging toward the closed position for easier insertion of the sheet goods into the display.

Figure 8:
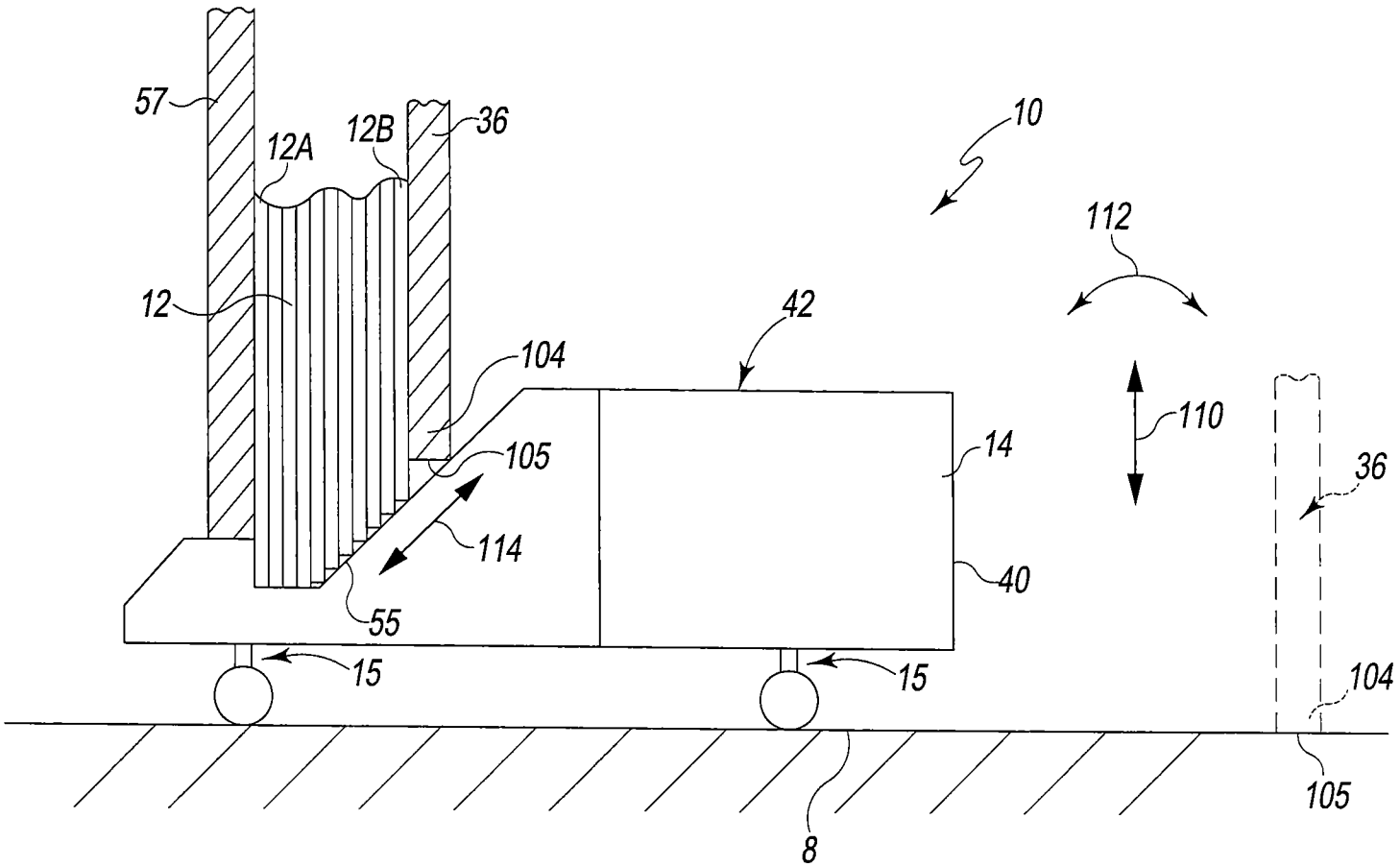
FIG. 8 is an elevation view of a lower end of a display stand, depicting different positions of a back member.

FIGS. 6, 7 and 8 illustrate a method of transferring sheet goods 12 into the display 10. The back member 36 can be moved to the open position, as represented by arrows 110 and 112 in FIG. 6. In the open position, the lower end 104 of the back member 36 can frictionally engage along a portion of an underlying support surface 8, as shown by the dashed lines in FIG. 8, where the weight of the back member can help retain the back member in the open position. When in the open position, the back members 36 can be positioned to be substantially parallel to one another, as shown in FIG. 6, or farther spread apart at an angle up to about 180 degrees apart. In FIG. 6, the sheet goods 12 can be bent to a curvature suitable in order to be inserted through the rear vertical standards 72 from the rear side of the display 10. The sheet good can be placed into the well 54 of the base 14 so that the bottom region along the bottom edge is placed against the frontward lip 48 of the base. The front of the sheet good can be placed against the front edges of the display that support the sheet goods. Any advertising or identifying label of the sheet good should be facing the front of the display, that is, the side an approaching customer is most likely to first view. When the sheet good has spikes or cleats, the sheet goods can be bent so that the cleats are preferably on the inside of the bend. Subsequent sheet goods can be bent to a curvature suitable in order to be inserted through the rear vertical standards from the rear side of the display. The subsequent sheet good can be placed into the well of the base so that the front side of the sheet can be in contact with the underside of the adjacent sheet good, and can take the curved shape and orientation of the adjacent sheet good.

After the desired number of sheet goods has been loaded into the display 10, the pair of back members 36 can be moved to the closed position, as shown in FIG. 7. For example, the back members 36 can move upward to an elevation so that the lower end 104 of the second leg 98 can clear the base 14 from the back. The back members 36 can pivot to the closed position so that the lower end 104 of the second leg 98 clears the elevation of the rear margin 40 of the base 14. This arrangement can allow the lower end 104 to frictionally engage any portion of the upper surface 42 of the base 14, as shown in FIG. 8. The lower end may be configured for enhanced frictional engagement, such as having a roughened surface or a soft durometer material such as an elastomer or rubber material, as shown in reference numeral 105. The rearward lip of the base may aid in retaining the lower end 104 of the back member 36 from being moved from the closed position. The weight of the back member 36 can also facilitate the retention of the back members in the respective open or closed position.

As sheet goods are inserted or removed from the display, the lower end 104 of the back member 36, when being moved to the closed position, can be selectively positioned along the upper surface 42 of the base, as represented by arrows 114, to contact the most rearward sheet good 12B regardless of its position in the well of the base. The combination of the front edge 57 and the selective position of the back member can facilitate the retaining of all of the sheet goods 12 in a standing position. For example, with reference to FIG. 8, the lower end 104 can move along the inclined surface 55 of the base 14 into contact with the most rearward sheet good 12B with the aid of gravity. The weight of the back member and the aid of gravity can facilitate support of the sheet goods 12 by the front edge 57 of the display, thereby retaining the sheets goods in a standing position. The base may have predetermined locations for the lower end, such as a ridged surface for the base in FIG. 4B or a stepped configuration as described in FIG. 4A, which may provide surface features to facilitate retaining the lower ends.

There can be several methods to remove a sheet good from the display. In one example, the most forward sheet good may be lifted from the front of the display so that the bottom edge can clear the second portion 78 of the support member. During the process of lifting, the sheet good may even be configured to be removed horizontally between the front edges 57. The remaining sheet goods can then be repositioned along the inclined surface and the well so that the most forward sheet good is against the front lip. The back member can also be repositioned to remain in contact with the most rearward sheet good. Optionally, the most rearward sheet good may be lifted from the front of the display so that the bottom edge can clear the top edges of the remaining sheet goods. Here, the back member can be repositioned to remain in contact with the most rearward sheet good. In the alternative, the most rearward sheet good can be removed from the back when the back member is positioned to the open position, with the operation of the display as described herein.

While these features have been disclosed in connection with the illustrated preferred embodiment, other embodiments of the invention will be apparent to those skilled in the art that come within the spirit of the invention as defined in the following claims.

The invention claimed is:

1. A display stand for a sheet good comprising:

a pair of upright side members each having a lower end;

a base coupled to the lower end of each of the upright side members, the base having an upper surface with a retaining well to support a lower edge of at least one sheet good to be stood upright in a standing position between the upright side members within the display stand, a portion of at least one of the retaining well or the upper surface of the base being inclined or including a series of steps, a front protrusion extending upward from said base to define an arcuate front lip, and a rear protrusion extending upward from said base to define an arcuate rear lip, the front and rear lips arranged to define boundaries of said retaining well, the arcuate front lip configured to impart a curvature to facilitate standing of the at least one sheet good in the standing position; and a back member coupled to at least one of the upright side members, the back member being movable between a first position to allow transfer of the at least one sheet good to and from the display stand, and a second position to inhibit transfer of the at least one sheet good to and from the display stand.

2. The display stand of claim 1, where said portion of at least one of the retaining well or the upper surface of the base includes a series of steps.

3. The display stand of claim 1, where said portion of at least one of the retaining well or the upper surface of the base includes an oblique surface.

4. The display stand of claim 1, where the base further comprises a front margin and a rear margin coupled to one another by the upper surface and a lower surface, the front margin and the rear margin being arcuate and concentric.

5. The display stand of claim 1, further comprising a tie member having ends coupled to an upper portion of each of the upright side members.

6. The display stand of claim 5, further comprising a display panel coupled to the tie member.

7. The display stand of claim 1, where the upright side members are laterally spaced from one another at a distance.

8. The display stand of claim 7, where each upright side member comprises a front portion, the front portions of the upright side members are spaced from one another to define front edges of the display to support the at least one sheet good in the standing position, and the front edges are laterally spaced from one another at a distance less than the lateral spacing of the upright side members.

9. The display stand of claim 1, where each of the upright side members comprises a rear vertical standard, a front vertical standard, and a support member coupling the rear and front vertical standards to one another, each of the rear and front vertical standards having a lower end coupled to the base, where the rear vertical standard and a first portion of the support member are co-planar along a first plane, and the front vertical standard and a second portion of the support member are co-planar along a plane different than the first plane.

10. The display stand of claim 9, where each of the upright side members further comprises a buttress rod having a first end fixed to one of the rear and front vertical standards and a second end coupled to the base, where the buttress rod is co-planar along the first plane.

11. A display stand for a sheet good comprising:

a pair of upright side members each having a lower end;

a base coupled to the lower end of each of the upright side members, the base having an upper surface that is inclined or includes a series of steps to support a lower edge of at least one sheet good to be stood upright in a standing position between the upright side members within the display stand; and at least one back member coupled to the upright side member, the at least one back member capable of moving between an open position and a closed position, where in the open position a first portion of the at least one back member is positioned away from the base to allow transfer of the at least one sheet good to and from the display stand, and where in the closed position said first portion is positioned at the base to inhibit transfer of the at least one sheet good to and from the display stand, and where the at least one back member further comprises a second portion pivotably and slidably attached to the upright side member so that the at least one back member is capable of swinging and sliding between the open position and the closed position.

12. The display stand of claim 11, where the at least one back member further comprises a retaining member that is configured to contact the at least one sheet good when the at least one back member is in the closed position.

13. The display stand of claim 11, where said first portion of the at least one back member comprises a lower end, where, when the at least one back member is in the closed position, the lower end is selectively positionable along the upper surface of the base.

14. The display stand of claim 13, where, when the at least one back member is in the open position, the lower end of said first portion of the at least one back member is positionable external to the base to a location lower than the upper surface of the base.

15. The display stand of claim 13, where the lower end of said first portion of the at least one back member has a frictional surface.

16. A display stand for a sheet good comprising:

a pair of upright side members each having a lower end;

a base coupled to the lower end of each of the upright side members, the base having an upper surface with an inclined portion to support a lower edge of one or more sheet goods to be stood upright in a standing position between the upright side members within the display stand, and a protrusion extending upward from said base to define an arcuate front lip, where the arcuate front lip is configured to impart a curvature to facilitate standing of the one or more sheet goods in the standing position; and a pair of back members coupled to the upright side members, each of the back members capable of moving between an open position and a closed position, where in the open position a first portion of the back member is positioned away from the base to allow transfer of the one or more sheet goods to and from the display stand, and where in the closed position said first portion is positioned at the base to inhibit transfer of the one or more sheet goods to and from the display stand;

where the upright side members are configured to define a front surface of the display stand to support the at least one sheet good in the standing position, and when the back member is in the closed position, a lower end of the first portion of the back member is selectively positionable at least along the inclined portion of the upper surface of the base to contact a most rearward sheet good.

17. The display stand of claim 16, where, when the back member is in the open position, the lower end of the back member is positionable external to the base to a location lower than the upper surface of the base.

18. The display stand of claim 17, where the back member is configured to swing along a portion of the upright side member and is configured to slide along a portion of the upright side member between the open position and the closed position.

19. The display stand of claim 18, further comprising a tie member having ends coupled to an upper end of each of the upright side members, and a display panel situated above and coupled to the tie member.

20. The display stand of claim 7 in combination with the at least one sheet good, where the at least one sheet good has a width, and the lateral distance between the upright side members is less than said width of the at least one sheet good.

* * * * *